United States Patent [19]

Settembre

[11] 4,184,696

[45] Jan. 22, 1980

[54] SAFETY BINDING FOR TOURING SKIS

[76] Inventor: Richard J. Settembre, 714 Velasko Rd., Syracuse, N.Y. 13207

[21] Appl. No.: 925,096

[22] Filed: Jul. 17, 1978

[51] Int. Cl.[2] ..... A63C 9/08

[52] U.S. Cl. ..... 280/615; 280/626

[58] Field of Search ..... 280/615, 635, 637, 626, 280/627, 628, 629, 623

[56] References Cited

U.S. PATENT DOCUMENTS

| | | | |
|---|---|---|---|
| 3,796,438 | 3/1974 | Zimmet | 280/637 |
| 4,004,823 | 1/1977 | Pyzel et al. | 280/615 |

*Primary Examiner*—Robert R. Song

*Attorney, Agent, or Firm*—Bruns & Jenney

[57] ABSTRACT

A safety binding for use in conjunction with cross-country skis that delivers a positive boot to ski action while at the same time having the ability to release in the event the skier experiences a lateral or twisting fall to one side or the other of the skis. The binding includes a toe-piece, mounted upon the front of the boot, that has an extended section which is slidably received within a housing mounted upon the top surface of the ski. The extended section of the toe-piece is held in contact against the rear wall of the housing by means of an detent mechanism having an adjustable spring tension. The side walls of the housing are open so that the toe-piece is able to pivot laterally in either direction about the rear wall of the housing so as to overcome the holding force of the detent and thereby allow the toe-piece to separate from the ski mounted housing.

11 Claims, 5 Drawing Figures

SAFETY BINDING FOR TOURING SKIS

BACKGROUND OF THE INVENTION

This invention relates to a safety binding for use in conjunction with cross-country skis and, in particular, to a cross-country safety binding that is capable of being adjustably tensioned to permit the binding to release when loaded to a predetermined pressure.

As is well-known in the art, most touring skis have a relatively long, narrow configuration which enables the ski to move or glide easily over relatively smooth, flat terrain. Typically, the toe of the boot is securely held to the ski by means of a cable or pin binding which, when locked in place, will not release in the event the skier falls. Of primary importance in the design of most touring ski bindings has been the ability of the binding to maintain the toe of the boot securely fastened to the ski while still permitting the boot to be flexed freely so that the skier may propell himself forward through means of a series of leg thrusts directed generally along the central axis of the ski. Although a light-weight, narrow ski performs quite well under these conditions, it nevertheless becomes an extremely unstable platform in the event the skier loses his balance for any reason.

It has long been thought that, because of the relatively quiet nature of this sport, little or no harm could come to a cross-country skier who might experience a fall. However, recent surveys have shown that a disturbingly large number of leg injuries have been sustained by cross-country skiers resulting from what is referred to as a lateral or "slow turning fall". In this type of fall, the skier begins falling to one side of the skis and, due to holding action of the long skis, his body is forced into a twisting motion as he approaches the ground. This, in turn, places a tremendous amount of stress on various parts of the leg. When this stress cannot be relieved, the leg can sustain serious damage.

SUMMARY OF THE INVENTION

It is therefore an object of the invention to improve cross-country ski bindings.

It is a further object of the present invention to provide a reliable safety binding system for use in conjunction with cross-country skiing equipment.

Another object of the present invention is to reduce the amount and the seriousness of injuries experienced by cross-country skiers.

A still further object of the present invention is to provide a safety-binding for use in conjunction with cross-country skis that can be easily engaged and disengaged by the user.

Yet another object of the present invention is to provide a safety-binding for use in cross-country skiing that is simple in both design and operation but yet rugged in construction.

These and other objects of the present invention are attained by means of a cross-country safety binding that includes a toe-piece which is affixed to a boot having an extended section depending forwardly therefrom, an open-sided housing mounted upon the skis for slidably receiving the extended section of the toe-piece therein, and a detent mechanism operatively associated with the housing that is arranged to hold the extended section of the toe-piece therein with the front wall of the extended section bearing against the rear wall of the housing whereby the toe-piece can pivot laterally upon the rear wall of the housing to overcome the holding force of the detent mechanism in the event the user experiences a lateral or twisting fall to either side of the skis.

BRIEF DESCRIPTION OF THE DRAWINGS

For a better understanding of these and other objects of the present invention, reference is had to the following detailed description of the invention which is to be read in conjunction with the following drawings, wherein.

DESCRIPTION OF THE INVENTION

Figure 1:
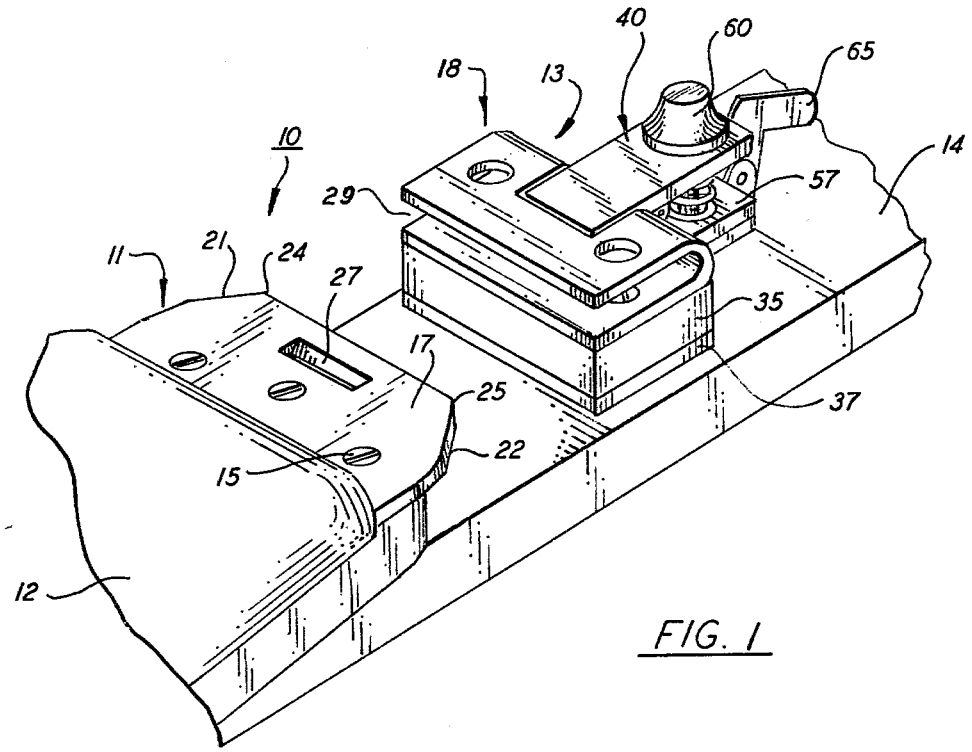
FIG. 1 is a partial prospective view of a binding encompassing the teachings of the present invention illustrating the boot-piece out of engagement with the ski-piece.
Figure 2:
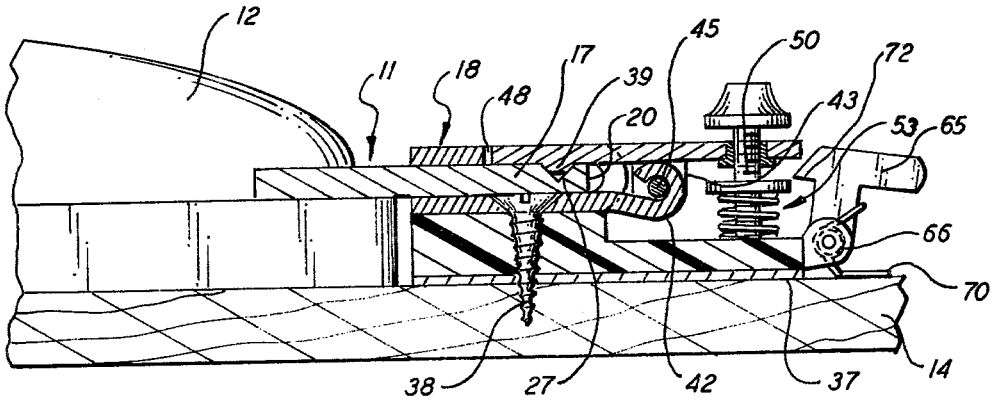
FIG. 2 is a partial side-elevation in section showing the toe-piece of the binding mounted in operable engagement with the ski-piece housing.
Figure 3:
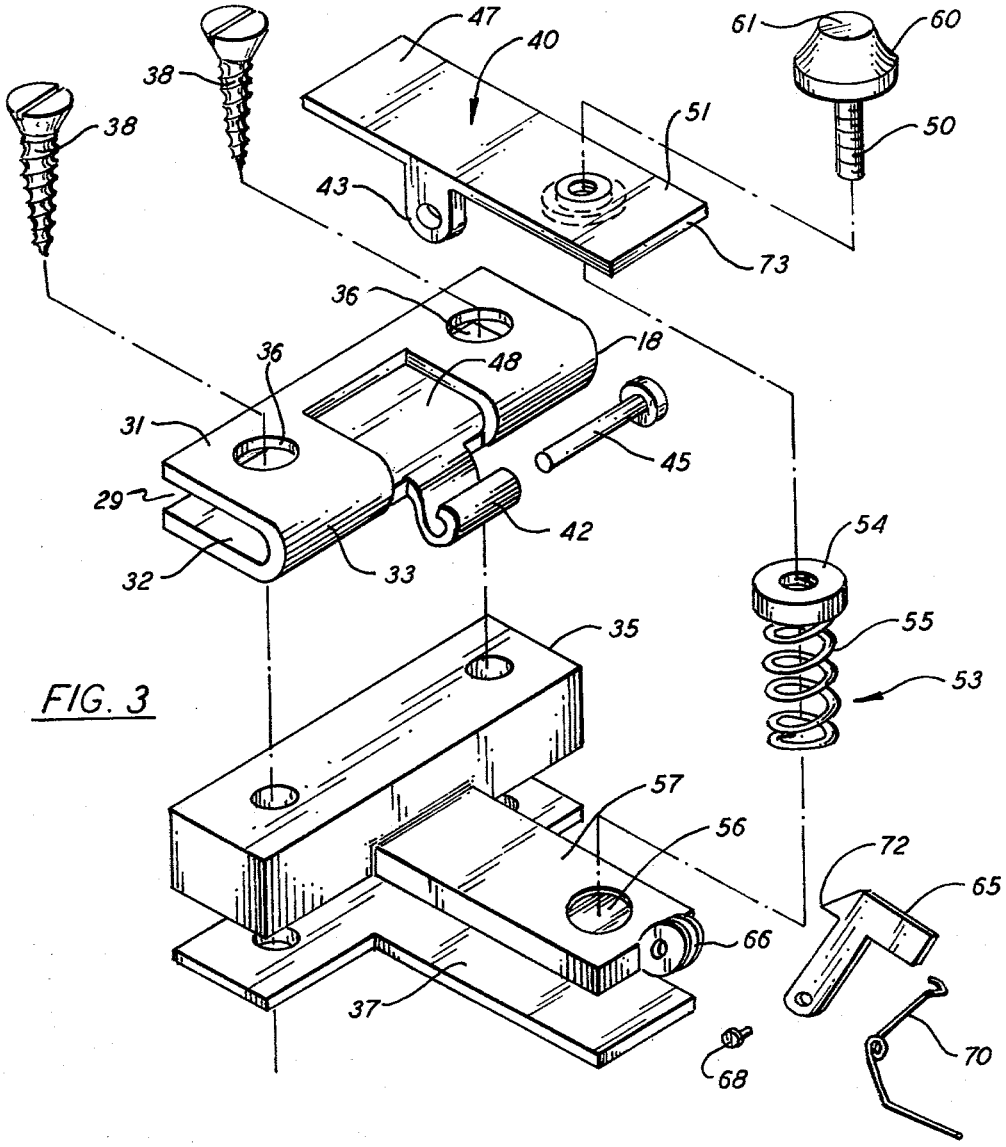
FIG. 3 is an exploded view of the ski-piece of the present binding showing the interrelationship of the various components thereof.

Referring initially to FIGS. 1, 2 and 3, there is illustrated a safety binding, generally referenced 10, that embodies the features of the instant invention. The binding includes two main sections; a first toe-piece 11, which is secured to ski boot 12, and a ski-piece 13 that is affixed to the top surface of a touring ski 14. The toe-piece is contoured to seat upon the front top surface of the boot sole and is affixed thereto by means of a plurality of screws 15 in a conventional manner so as to rigidly secure the toe-piece to the boot. The toe-piece is provided with a forwardly extended section 17 that is arranged to be slidably received within a semi-enclosed housing 18 contained in the ski-piece of the binding.

In practice, the extended section 17 of the toe-piece is a flat planar member that is cantilevered from the front of the boot to horizontally position the member in parallel relationship with the top surface of the ski when the boot is situated thereupon. The extended section further includes a vertical front wall 20 normal to the central axis of the toe-piece and which extends an equal distance to either side thereof. The two side walls 21, 22 of the toe-piece are brought obliquely into the front wall to form two rather sharp vertical edges 24, 25 therewith, the purpose of which will be described in greater detail below. An elongated detent notch 27 is also formed in the top surface of the extended section of the toe-piece with the notch preferably having a V-like configuration, although any other suitable geometry may be similarly employed. The elongated notch runs parallel with the front wall of the toe-piece at a predetermined distance therefrom.

With more specific reference to FIGS. 2 and 3, the flat extended section of the toe-piece is adapted to slide easily into the opening 29 provided in semi-enclosed housing 18. The housing basically consists of a top wall 31 and a bottom wall 32 that are joined together by means of an arcuate shaped rear wall 33. In practice, the housing is preferably fabricated from a single piece of relatively heavy gauge metal plate possessing sufficient strength to withstand the forces exerted thereon during skiing without appreciably deforming or bending. The spacing between the top wall and the bottom wall of the housing is accurately maintained to provide a close running fit between the inner surfaces of the walls and the outer surfaces of the extended section of the toe-piece slidably received therein.

As a result of this arrangement, little or no vertical movement is permitted between the two co-mounted members. As a consequence, any forward movement of the boot that is intended to propel the ski is immediately translated through the housing directly into the ski.

Figure 4:
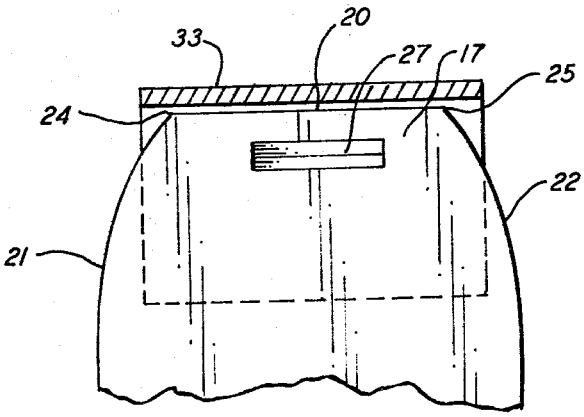
FIGS. 4 and 5 are partial schematic views showing the front edge of the toe-piece seated against the rear wall of the ski-mounted housing.
Figure 5:
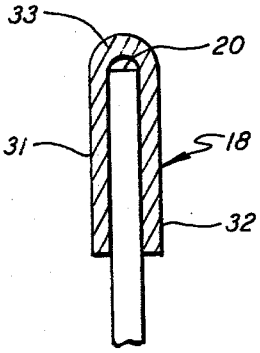

When properly positioned within the housing, the front wall 20 of the toe-piece will be resting in contact against the rear wall 33 of the housing as illustrated in FIGS. 4 and 5. In this particular case, where the front wall of the housing is generally arcuate in form, only the top and bottom edges of the front wall 20 bear against the rear wall 33 of the housing. Sufficient bearing contact is maintained along the two edges to insure that the boot is properly aligned with the ski and to transmit boot initiated action faithfully to the ski in an unbroken line whereupon the ski will respond instantly to the skier's demands. Although a curved back wall to the housing is herein shown, it should be clear from the discussion above that any suitable shape which will co-act with the toe-piece in the manner disclosed can be used without departing from the teachings of the present invention.

As best illustrated in FIG. 3, the housing 18 is elevated above the top surface of the ski by means of a base member 35 which serves to raise the housing to a height where it can accept the toe-piece of the boot. Spacers of various thicknesses, as for example spacer 37, may also be placed under the base member to enable the housing to be more accurately aligned with the toe-piece. A pair of flat-headed wood screws 38—38 are used to secure the housing to the top surface of the skis. As seen in FIG. 2, each screw is seated within the bottom wall of the housing and is arranged to pass downwardly through holes provided in both the base member and the spacer member into the body of the ski. The pair of enlarged access holes 36—36 are formed in the top wall of the housing which provides sufficient clearance to enable the screws to be properly mounted in assembly.

A detent mechanism is herein utilized to hold the toe-piece of the binding in engagement with the ski piece. The mechanism is made of the previously-noted notch 27 formed in the toe plate and a complimentary V-shaped pin 39 that depends downwardly from the bottom surface of a balance beam of lever 40. The beam is pivotally mounted at the rear wall of the housing in a horizontally aligned hinge post 42. A pair of cored, centrally-located, tabs 43—43, which extend downwardly from the bottom surface of the beam, are brought over the ends of the hinge post and a hinge pin 45 is passed through the openings provided in the hinge-forming members to rotatably support the beam in assembly. The tabs are arranged to bring the beam to a height whereby extended rear 47 of the beam may be brought into horizontal alignment with a complimentary opening 48 formed in the top wall of the housing. An adjusting screw 50 is threadedly passed through the extended front leg 51 of the beam and actively engages a spring biasing mechanism, generally referenced 53, that is adapted to apply an upwardly urging force upon the adjacent leg of the beam.

The biasing mechanism 53 consists of a cap 54 containing one end of a compression spring 55 seated therein. In assembly, the opposite or free end of the spring is seated in a recess 56 formed in horizontal dependent arm 57 of the base member 35. In assembly, the shank of the adjusting screw 50 is secured in the cap 54 to enable the cap to move up and down with the shank. Turning the adjusting screw in one direction will compress the spring and thus increase the biasing force exerted by the spring on the beam while turning it in the opposite direction will have the opposite effect. Under the influence of the spring, the detent pin is seated under pressure within the detent notch. The amount of pressure delivered by the system is determined by the amount of force exerted against the beam by the spring. An enlarged head 60 is secured to the top of the adjusting screw to facilitate hand turning of the screw. The top of the screw head contains a concave surface 61 into which the tip of a ski pole may be inserted to depress the spring and thus raise the beam to a detent release position, thereby allowing the toe-piece to be pulled out of the housing.

A latch mechanism 65 is pivotively supported within a hinge 66 formed on the front surface of the arm 57 by means of a pivot pin 68. The latch is biased in a counter-clockwise direction by means of a spring member 70 supported on the hinge pin 68 which is to act between the top surface of the ski and the body of the latch as shown in FIG. 2. A clasp 72 on the latch is adapted to catch the forward edge 73 of the balancing beam when the beam is rotated clockwise to the detent release position wherein pin 39 is clear of notch 27. Under the biasing pressure of spring 70, the clasp will be pushed over the top surface of the beam to hold the beam in a latched position until such time as the latch is physically released. This may be simply accomplished by taping the top of the latch with a ski pole or the like. Automatic latching of the balance beam is accomplished by simple moving the beam down the inclined front surface of the latch a sufficient distance to allow the clasp to move into a holding condition.

With the toe-piece of the binding secured in an operative position within the housing, the upper and lower horizontal edges of the front wall 20 of the toe-piece are held in seating contact against the back wall 33 of the housing as described above. Accordingly, vertical edges 24 and 25 of the toe-piece form a pair of fulcrums or pivot points about which the boot may be turned when it moves in a lateral direction, as for example, when the skier experiences a fall to either side of his skis. During the course of the fall it is quite possible that one or both skis will become entangled or entrapped in the snow, thereby preventing movement thereof. However, as the heel of the boot continues to turn, the boot will want to pivot about one of the pivot points 24, 25. When sufficient lateral pressure is exerted upon the binding to overcome the holding force of the detent mechanism, the binding will release, thereby freeing the boot from the ski and thus prevent an injury from occurring. As can be seen, the release pressure exerted by the detent mechanism may be adjusted to compensate for the skier's weight and skiing ability by simply tensioning spring 55 to a predetermined level.

As should be evident from the disclosure above, the present binding has the unique ability to align the boot of a skier with the ski, firmly holding the boot to the ski as the skier walks or glides over the snow, and releasing the boot at a predetermined pressure in the event the skier loses his balance and falls to either side of the skis. While this invention has been disclosed with specific reference to the details set forth above, it is not limited to the specific structure as disclosed and the invention is intended to cover any modifications or changes that may come within the scope of the following claims.

I claim:

1. A safety binding for use in conjunction with a touring ski including a toe piece having means for securing the toe piece to a boot and containing a horizontal planar male member being adapted to extend forwardly from said boot, the male member having a vertical front wall at its distal end and an elongated transversely extended detent groove formed in the top surface thereof, a ski piece including means to secure the ski piece to the top surface of a ski, a female member for slidably receiving the male member therein that is formed of a top wall and a bottom wall that are spaced apart a set distance to provide a close running with the male member, the top wall having an opening formed therein, and a rear wall cojoining the top and bottom walls and being adapted to engage the front wall of the male member substantially along its length, a lever having a centrally located hinge affixed to the ski piece forward of the female member so that one leg thereof reciprocates within the opening in the top wall of the female member as the lever is moved back and forth about the hinge, said one leg having a detent pin depending therefrom which compliments the detent groove formed in the male member and is adapted to seat therein to hold the front wall of the male member in engagement with the rear wall of the female member, and an adjustable tensioning means acting against the other leg of the lever to force the detent pin into the detent groove with a predetermined force.

2. The binding of claim 1 wherein the detent groove is symmetrically positioned about the central axis of the male member and is located a predetermined distance from each end of the front wall whereby the toe piece is allowed to pivot laterally about either end point against the holding pressure of the detent pin thereby releasing the toe piece from the ski piece in the event the holding force of the detent pin is exceeded.

3. The binding of claim 1 further including a base mounted between the ski and the female member for raising the female member above the top surface of the ski.

4. The binding of claim 3 having a releasable latch pivotably mounted in the base that is adapted to engage the said other leg of the lever when placed in a first position to hold the detent pin out of engagement with the detent notch and to release the lever when placed in a second position.

5. The binding of claim 4 which further includes a biasing means acting upon said latch to urge the latch into the second position.

6. The binding of claim 3 including further spacer means positioned between the base and the top surface of the ski to adjust the height of the female member.

7. The binding of claim 1 which further includes means to override the tensioning means whereby the detent pin may be rapidly released from seating engagement within the detent groove.

8. A safety binding for use in conjunction with a touring ski including a toe piece that is adapted to be secured to the front of a ski boot, said toe piece having a male member that extends forwardly from the boot and which terminates with a vertically aligned front surface, a ski piece that is adapted to be secured to the top surface of a ski, the ski piece including an open sided female member having a bottom wall and a spaced apart top wall having inside surfaces for receiving the male member in close sliding relationship therebetween and a rear wall having an inner surface that compliments the front surface of the male member, and at least one detent mechanism acting between the toe piece and the ski piece having a pin that is supported in one of said pieces and a biasing means acting upon the pin to urge the pin toward the other of said pieces, and a receiving notch formed in the other of said pieces for slidably receiving the pin therein, said notch having at least one surface capable of coacting with the pin to pressure the front surface of the toe piece in bearing contact against the rear wall of the ski piece whereby the toe piece is able to rotate laterally within the ski piece in the event the holding pressure of the pin is overcome by the boot thereby freeing the toe piece from the ski piece.

9. The safety binding of claim 8 wherein the said, at least one, detent mechanism is located a predetermined distance from one of the vertical corner edges of the front surface of said male member to allow the male member to pivot laterally about the corner against the holding force of said detent.

10. The safety binding of claim 8 that further includes an adjusting means operatively associated with the biasing means pin for regulating the amount of force exerted by the pin upon the notch.

11. The safety binding of claim 8 that further includes a latch that is movable between a first and a second position, said latch being arranged to hold the detent pin out of engagement with the detent notch when placed in a first position and to release the pin when placed in a second position.

* * * * *